166-274 SR

8/19/80 XR 4,217,955

United States Patent [19]

Sigmund et al.

[11] 4,217,955

[45] Aug. 19, 1980

[54] OIL RECOVERY PROCESS

[75] Inventors: Phillip M. Sigmund, Bragg Creek; Jong I. Lee, Calgary; James E. Fosti, Calgary, all of Canada

[73] Assignee: Petroleum Recovery Institute, Calgary, Canada

[21] Appl. No.: 6,809

[22] Filed: Jan. 25, 1979

[30] Foreign Application Priority Data

May 15, 1978 [CA] Canada ..... 303344

[51] Int. Cl.[3] ..... E21B 43/22

[52] U.S. Cl. ..... 166/252; 166/273; 166/274

[58] Field of Search ..... 166/273, 274, 305 R, 166/252, 263

[56] References Cited

U.S. PATENT DOCUMENTS

| | | | |
|---|---|---|---|
| 2,875,830 | 3/1959 | Martin | 166/274 X |
| 2,968,350 | 1/1961 | Slobod et al. | 166/273 |
| 3,003,554 | 10/1961 | Craig, Jr. et al. | 166/274 |
| 3,096,821 | 7/1963 | Dyes | 166/273 |
| 3,120,262 | 2/1964 | Archer | 166/263 |
| 3,249,157 | 5/1966 | Brigham et al. | 166/273 |
| 3,353,597 | 11/1967 | Mulder | 166/274 X |
| 3,354,953 | 11/1967 | Morse | 166/274 X |
| 3,532,165 | 10/1970 | Raifsnider | 166/274 X |
| 3,661,208 | 5/1972 | Scott et al. | 166/274 |
| 3,811,501 | 5/1974 | Burnett et al. | 166/274 X |

*Primary Examiner*—Stephen J. Novosad

*Attorney, Agent, or Firm*—George H. Dunsmuir

[57] ABSTRACT

The recovery of oil from a subterranean hydrocarbon-bearing reservoir by the injection thereinto of a mixture of carbon dioxide and sulfur dioxide which is miscible with the reservoir oil at pressure and temperature prevailing in the reservoir. For production a driving fluid is then injected to displace the zone and reservoir oil and fluids for recovery.

7 Claims, 4 Drawing Figures

PHASE ENVELOPES OF $CO_2$ - $SO_2$ - PEMBINA OIL AT 45°C

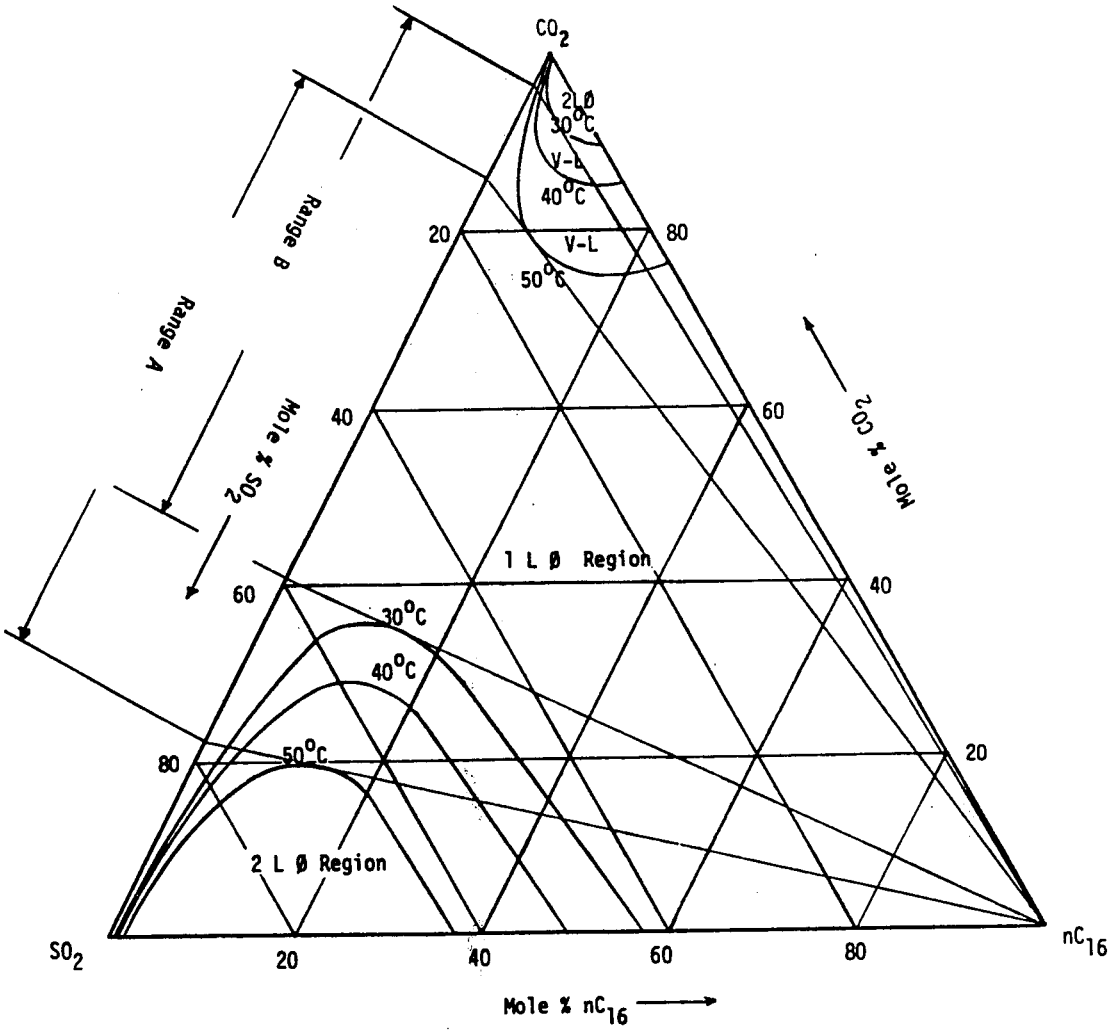
FIG. 1 PHASE ENVELOPES OF $CO_2$ - $SO_2$ - $nC_{16}$ SYSTEM AT 1500 PSIA

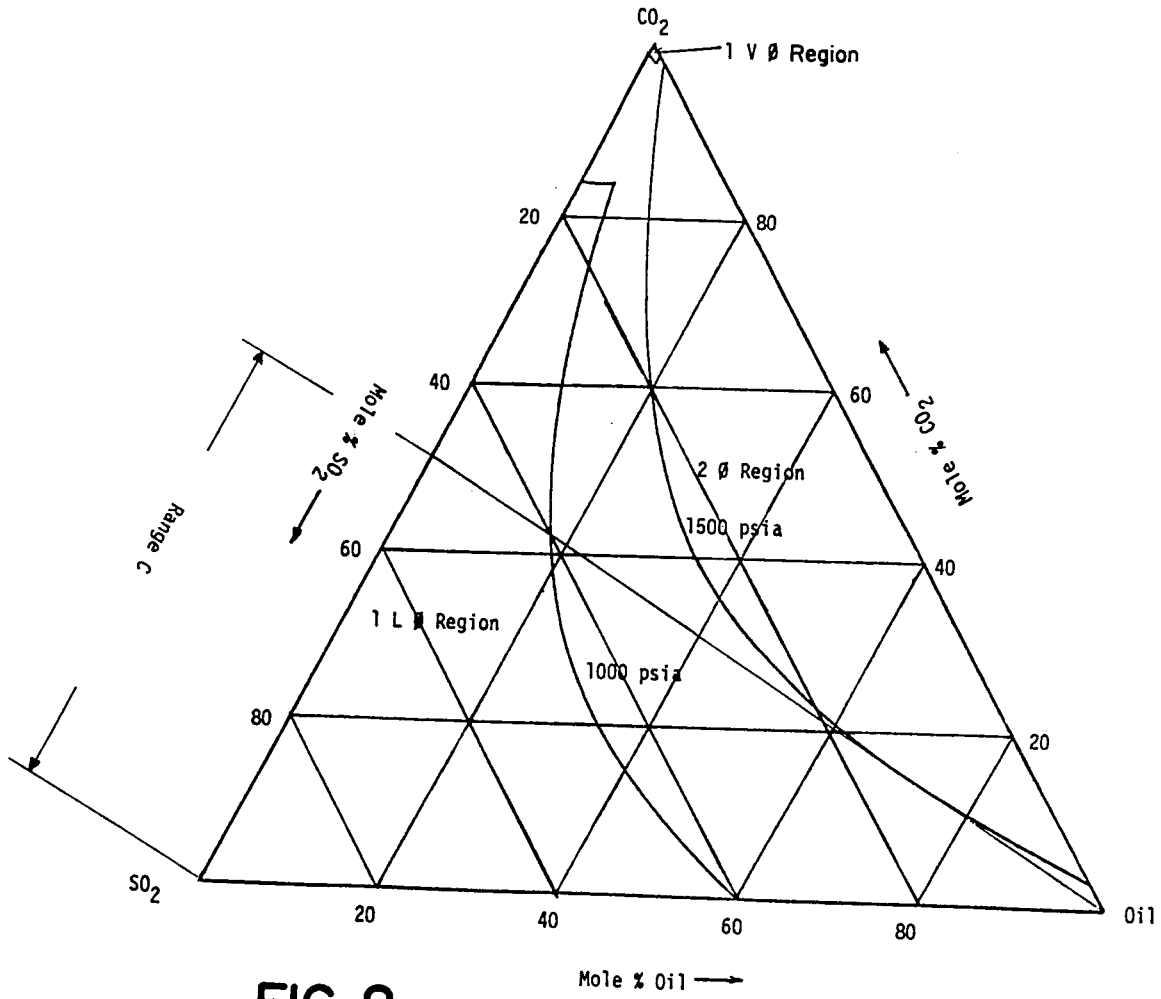
FIG. 2 PHASE ENVELOPES OF $CO_2$ - $SO_2$ - PEMBINA OIL AT 45°C

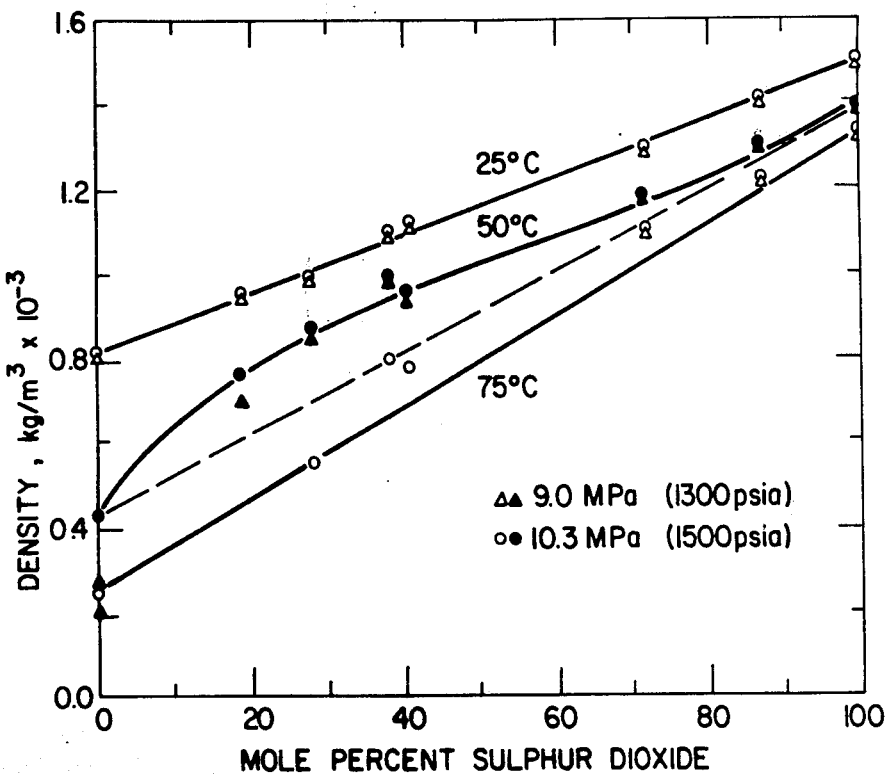
*Figure 3 - Density of $CO_2$-$SO_2$ mixtures*

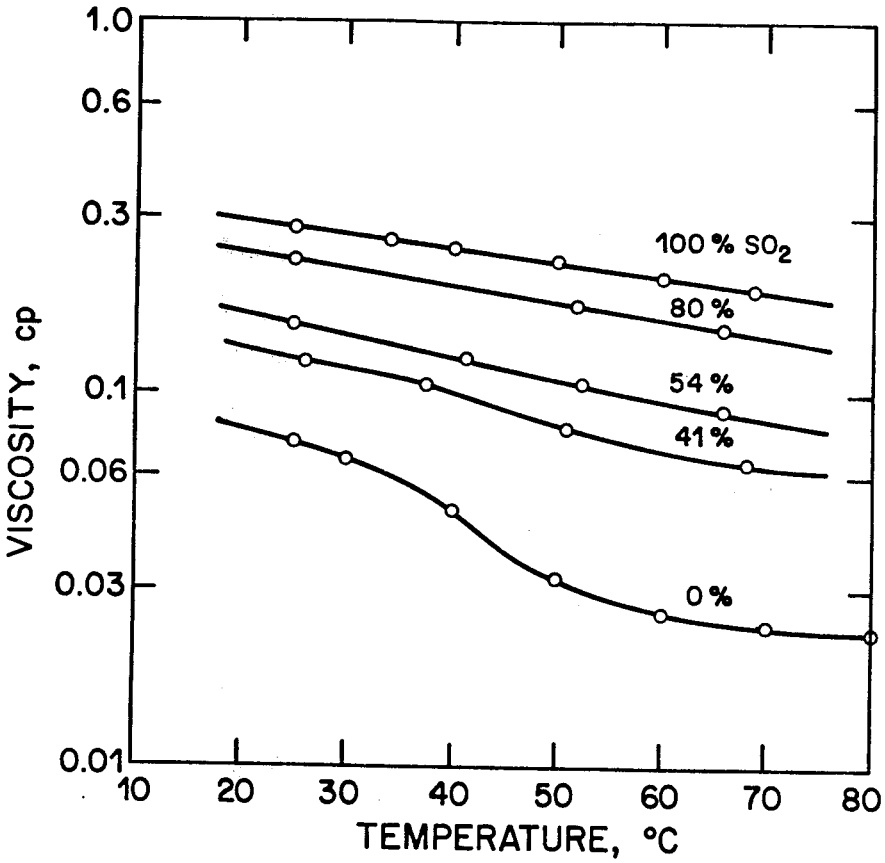
*Figure 4 - Viscosity of $CO_2$ -$SO_2$ mixtures versus temperature at 1500 psia.*

OIL RECOVERY PROCESS

BACKGROUND OF THE INVENTION

This invention relates to the recovery of oil from an oil-bearing reservoir wherein a mixture of carbon dioxide and sulfur dioxide is injected into the reservoir at a pressure at which the mixture is miscible with the reservoir oil in an amount sufficient to form a miscible zone with reservoir oil at the reservoir conditions of pressure and temperature. The invention also relates to the recovery of the oil and to the stimulation of an injection and/or a production well bore and/or their vicinities to increase injectivity and/or productivity by a single well operation.

For production a driving agent is then injected to displace the miscible oil, sulfur dioxide, and carbon dioxide mixture along with reservoir oil and fluids. Production can be from a single well, or injection can be into an injection well with recovery at a production well.

DESCRIPTION OF THE PRIOR ART

It has long been recognized that capillary and interfacial forces are important factors in controlling the efficiency of recovery of oils from subterranean reservoirs. These forces cause the retention of oil in the reservoir matrix and they control fluid movement. If a method could be achieved that would remove these interfaces, the advancing and driving fluids would sweep through the entire reservoir resulting in complete oil recovery. A solvent miscible with the reservoir oil would provide such a means.

Miscible recoveries of oil are normally accomplished by displacement techniques whereby a fluid that is miscible with the reservoir oil is injected into a reservoir and this serves to displace the oil through the reservoir and toward a production well from which the oil is produced. Normally, the fluids used are light hydrocarbons and mixtures thereof, such as parraffins in the $C_2$ and $C_6$ range, and in particular, liquid petroleum gas.

As a result of high demand for natural gas and hydrocarbon solvents, other kinds of miscible agents must now be found. Carbon dioxide has been used as an oil recovery agent wherein recovery is improved by taking advantage of the solubility of the carbon dioxide in the oil, causing viscosity reduction, oil swelling, interfacial tension reduction, and vaporization of crude oil, thereby leading to increased recovery. However, a very high pressure is required for carbon dioxide to be a complete miscible agent. Generally, the direct miscibility pressure for the carbon dioxide and oil system is greater than about 3000 psia. Early breakthrough of carbon dioxide because of its low vicosity and hence mobility has been another problem with the carbon dioxide injection process. A low recovery efficiency can result and the alternating injection of water and gas (WAG process) has been used to try to improve the problem.

Sulfur dioxide has been used as a refinery solvent to separate aromatic hydrocarbons or low molecular weight hydrocarbons from a crude oil; however, to achieve a complete miscibility with a high molecular weight hydrocarbon, a very high temperature is a necessary factor. The viscosity of sulfur dioxide is 3 to 6 times higher than that of carbon dioxide at prevailing reservoir conditions.

OBJECTS OF THE INVENTION

It is an object of the present invention to utilize carbon dioxide and sulfur dioxide and sulfur dioxide by determing a range of mixture compostions to obtain a complete miscibility between reservoir oil and a mixture of carbon dioxide and sulfur dioxide to increase productivity, stimulate production and improve injectivity when neither pure carbon dioxide nor sulfur dioxide are miscible with the oil at the reservoir conditions.

it is a further object of this invention to provide means for determining the critical ratio of carbon dioxide to the sulfur dioxide to formulate a matching density with that of reservoir oil or that of formation water to avoid gravity override; subsequently to increase volumetric sweep efficiency of the interested reservoir.

It is still a further object of this invention to utilize mixtures of carbon dioxide and sulfur dioxide to achieve a mobility more similar to that of reservoir oil so that the viscous fingering problem is alleviated and a higher recovery is attained before solvent breakthrough.

Another object and purpose of this invention is to provide a method for improving productivity and stimulating recovery of oil from a subterranean hydrocarbon-bearing reservoir which comprises injecting a mixture of $CO_2$ and $SO_2$ into the reservoir in ratio and volume to form with oil in the reservoir a zone wherein carbon-dioxide, sulfur dioxide and oil are miscible at pressure and temperature prevailing in the reservoir.

A still further purpose is to provide a method for increasing oil production from a subterranean reservoir comprising injecting into the reservoir under pressure a mixture of carbon dioxide and sulfur dioxide in ratio and volume to form a zone of miscibility with the reservoir oil at temperature and pressure within the reservoir and thereby injecting a driving fluid into the reservoir to displace the zone of miscibility and reservoir oil and fluids for recovery.

An additional object is to provide a method for improviding productivity and stimulating recovery of oil from a subterranean-bearing reservoir comprising determining pressure and temperature conditions within the reservoir, and sampling oil from the reservoir and determining the ratio of oil, carbon dioxide and sulfur dioxide to provide a miscible mixture at said determined pressure and temperature conditions, and injecting a slug of carbon dioxide and sulfur dioxide of predetermined ratio and in sufficient quantity to establish a zone of miscible oil, carbon dioxide and sulfur dioxide.

The invention also relates to the further step of injecting driving fluid into the reservoir to displace the said zone discussed above and reservoir oil for recovery.

The invention also relates to the step of matching the density of the carbon dioxide and sulfur dioxide mixture with the density of the reservoir oil or formation water to maximize the volumetric sweep efficiency. In addition, the invention includes the step of combining the sulfur dioxide and carbon dioxide in a suitable proportion to cause the viscosity of the mixture to be more compatible with that of the reservoir oil, and hence to minimize problems due to viscous fingering.

BRIEF DESCRIPTION OF THE ACCOMPANYING DRAWINGS

FIG. 1 illustrates a three-component composition diagram for a carbon dioxide-sulfur dioxide-n-hexadecane system of 1500 psia and at various temperatures, showing a wide range of completely miscible zone between the oil (n-hexadecane) and a mixture of carbon dioxide and sulfur dioxide;

FIG. 2 demonstrates a similar phenomena for the system of carbon dioxide-sulfur dioxide-crude oil at 45° C., with superimposed two, two-phase envelopes thereon for different pressures; and FIG. 3 shows mixture densities of carbon dioxide and sulfur dioxide at temperatures of 25°, 50° and 75° C., and at pressures of 1300 and 1500 psia;

FIG. 4 shows the viscosity of $CO_2$-$SO_2$ mixtures at 1500 psia and various temperatures. The viscosities of $CO_2$-$SO_2$ mixtures are higher than for pure $CO_2$.

DETAILED DESCRIPTION OF THE INVENTION

In one aspect, the invention comprises introducing into an oil-bearing reservoir a slug of a mixture of carbon dioxide and sulfur dioxide that is capable of forming a miscible transition zone with the reservoir oil, and thereafter injecting a driving fluid to displace the oil through the reservoir to a production well. The injection also provides a stimulation agent for the injector and producer wells to improve injectivity and/or productivity. Stimulation and productivity are also enhanced in a single well operation.

The invention resides in the fact that the reservoir is flooded under conditions at which direct miscibility exists between the slug mixture and the reservoir oil. It is applicable, but not restricted to, reservoirs which are too low in pressure to allow carbon dioxide and/or which are too low in temperature to allow sulfur dioxide alone to be directly miscible with the oil.

It has been determined that there is a minimum pressure at which miscibility can exist between the oil and the mixture of carbon dioxide and sulfur dioxide at a given reservoir temperature. This minimum pressure can be determined by means of equilibrium phase behavior study of the pseudo ternary system consisting of carbon dioxide, sulfur dioxide and crude oil.

A further insight into the invention can be obtained from FIGS. 1 through 4. FIG. 1 shows an idealized three-component system of carbon dioxide, sulfur dioxide and n-hexadecane which represents a non-volatile oil.

A series of experiments were conducted by injecting a known amount of each component in a windowed PVT (pressure-volume-temperature) cell and a bubble point and/or a two liquid phase formation was visually observed by varying temperature and pressure. Occasionally, vapor and liquid or two different liquids samples were withdrawn for further analyses. Various combinations of a mixture of three components, permitted determination of the boundary between two different phases, indicating that in the "Range A" are completely miscible mixtures of carbon dioxide and sulfur dioxide with n-hexadecane at 50° C. and at 1500 psia, and mixtures in "Range B" are miscible at 30° C. and at 1500 psia, while carbon dioxide or sulfur dioxide alone is not miscible with n-hexadecane at the same conditions.

An example with a reservoir crude oil which has been reconstituted with methane to represent a solution gas is shown in FIG. 2. The oil had a pentane-plus molecular weight 210 and 230 cubic feet of methane per barrel of stock tank oil. Experiments were conducted at 45° C., and at pressures up to 1500 psia. The range of complete miscibility for this crude oil with mixtures of carbon dioxicde and sulfur dioxide is indicated as "Range C".

As shown in FIG. 3, mixture density of carbon dioxide and sulfur dioxide varies with molar ratio of two components and with temperaure and pressure.

In a practical application of the reservoir one can formulate a critical mixture of carbon dioxide and sulfur dioxide within the completely miscible range for a given reservoir temperature and pressure. As shown in FIG. 3 such a mixture may also be used to closely match density of a reservoir oil or of a formation water to improve volumetric sweep efficiency by reducing the gravity segregation which may otherwise occur. The corresponding density data of the mixture of carbon dioxide and sulfur dioxide for the critical range applicable are indicated in FIG. 3.

As shown in FIG. 4, the viscosity of liquid sulfur dioxide is 3 to 6 times higher than that of carbon dioxide at equivalent temperatures and pressures. Also, the viscosity of carbon dioxide-sulfur dioxide mixtures is higher than for pure $CO_2$. For example, 50 mole % $CO_2$ in $SO_2$ at 50° C. and 1500 psia is about 3 times more viscous than pure carbon dioxide at the same conditions.

The use of carbon dioxide and sulfur dioxide in field applications can thus reduce viscous fingering which tends to be a problem with the carbon dioxide injection process.

The process can be used either as an enhanced recovery flooding or a process for stimulation purposes or both.

In summary, in accordance with the practice of this invention, a miscibility test is carried out in the following manner. There is introduced into the reservoir a mixture of carbon dioxide and sulfur dioxide that is capble of forming with the reservoir oil, at the temperature and pressure thereof, a zone of complete miscibility. The composition of the mixture, or the critical ratio of the components may be determined by means of pressure-volume-temperature (PVT) tests. Also the matching density of the mixture may be chosen from FIG. 3 to maximize volumetric sweep efficiency, and to reduce viscous fingering. After an amount of carbon dioxide and sulfur dioxide sufficient to establish a slug has been injected, there can be introduced into the formation a driving fluid such as a gas, a vapor, water, and/or their mixtures. The injection of the driving fluid is continued so as to move the fluids of the reservoir through the reservoir toward a production well from which the reservoir oil is recovered. By operating in the above indicated manner, a substantially complete displacement of the reservoir oil is realized.

What is claimed is:

1. A method for improving the recovery of oil from a subterranean hydrocarbon-bearing reservoir by the injection of sulfur dioxide and carbon dioxide gases which are individually immiscible with the oil at the prevailing reservoir conditions of temperature and pressure comprising injecting into said reservoir a mixture of sulfur dioxide and carbon dioxide in a ratio at which said mixture is directly miscible with the oil in the reservoir at said conditions.

2. A method as in claim 1 and including injecting said mixture in the form of a slug, and thereafter injecting a driving fluid into said reservoir.

3. A method as in claim 2 and including injecting another slug of mixture and thereafter continuously injecting a driving fluid into said reservoir.

4. A method as in claim 1, 2 or 3 and including adjusting said ratio as a function of the density of the reservoir oil to improve the volumetric sweep efficiency of the recovery.

5. A method as in claim 1, 2 or 3 and including adjusting the density and viscosity of said mixture by adjusting said ratio so as to optimize the compatability of said mixture with the fluids in said reservoir.

6. A method for improving the recovery of oil from a subterranean hydrocarbon-bearing reservoir by the injection of sulfur dioxide and carbon dioxide gases which are individually immiscible with the oil at the prevailing reservoir conditions of temperature and pressure comprising:

measuring the pressure and temperature conditions within said reservoir, preparing a mixture of sulfur dioxide and carbon dioxide in a ratio such that said mixture is directly miscible with the oil at said conditions, and injecting a slug of said mixture into said reservoir.

7. A method as in claim 1, 2 or 6 and including:

sampling the oil in said reservoir and measuring the density thereof, adjusting the density of said mixture as a function of the density of the oil by adjusting said ratio so as to improve the volumetric sweep efficiency of the recovery.

* * * * *